US005689784A

United States Patent [19]

Shin et al.

[11] Patent Number: 5,689,784

[45] Date of Patent: Nov. 18, 1997

[54] NON-CONTACTING, NON-MAGNETIC, MONO-COMPONENT DEVELOPING APPARATUS

[75] Inventors: Kyu-chul Shin; Kyung-hwan Kim, both of Seoul, Rep. of Korea

[73] Assignee: Samsung Electronics Co., Ltd., Suwon, Rep. of Korea

[21] Appl. No.: 357,609

[22] Filed: Dec. 15, 1994

[30] Foreign Application Priority Data

Jun. 30, 1994 [KR] Rep. of Korea ..... 94-15692

[51] Int. Cl.[6] ..... G03G 15/08

[52] U.S. Cl. ..... 399/285; 399/265

[58] Field of Search ..... 355/245, 259, 355/261, 265; 118/653, 651, 661; 399/222, 252, 258, 265, 279, 284, 285

[56] References Cited

U.S. PATENT DOCUMENTS

| | | |
|---|---|---|
| 4,656,965 | 4/1987 | Hosoya et al. . |
| 4,769,676 | 9/1988 | Mukai et al. . |
| 4,797,335 | 1/1989 | Hiratsuka et al. . |
| 4,806,992 | 2/1989 | Yasuda et al. . |
| 4,990,963 | 2/1991 | Yamamoto et al. . |
| 5,086,728 | 2/1992 | Kinoshita . |
| 5,155,532 | 10/1992 | Sakurada et al. . |
| 5,223,668 | 6/1993 | Takaya et al. . |
| 5,239,344 | 8/1993 | Enoki et al. . |
| 5,245,391 | 9/1993 | Suzuki et al. . |
| 5,255,057 | 10/1993 | Stelter et al. . |
| 5,286,918 | 2/1994 | Iwata et al. . |
| 5,287,150 | 2/1994 | Kinoshita et al. . |
| 5,311,264 | 5/1994 | Kinoshita . |
| 5,379,097 | 1/1995 | Aoto et al. . |

*Primary Examiner*—Sandra L. Brase
*Attorney, Agent, or Firm*—Dvorak & Orum

[57] ABSTRACT

An electrophotography developing apparatus of non-contacting type using a nonmagnetic one-component toner is provided. The developing apparatus adopts a soft roller as a developing roller and a developing gap of 50–200 μm is formed between a developing drum and developing roller. A desirable image can be provided by adopting the soft roller as the developing roller and properly setting the developing gap between the developing roller and the developing drum. Generally, the electrophotography developing apparatus is used in the apparatus for printing and communicating, such as a duplicator, a printer and a facsimile.

2 Claims, 4 Drawing Sheets

NON-CONTACTING, NON-MAGNETIC, MONO-COMPONENT DEVELOPING APPARATUS

BACKGROUND OF THE INVENTION

The present invention relates to an developing apparatus, and more particularly, to an electrophotography developing apparatus employing a mono-component developer containing a non-magnetic toner.

The conventional dry-type developing method can be classified generally into one of two kinds: one employing a bi-component developer containing toner and carrier and the other employing a mono-component type developer containing no carrier. The former method, developed long ago, provides a relatively stable and good quality copy image, but has several disadvantages such as a deterioration of the carrier and undesirable variations in the toner-to-carrier mixing ratio, over time after developing, general difficulty in the maintenance of the copy machine, and limitations to the miniaturization of the machine itself. Therefore, the mono-component type developing method is more desirable.

Here, the general mono-component developing method is classified into magnetic and non-magnetic types. In the case of the magnetic mono-component developing method, a magnetic material is included in the toner and the toner is moved by a magnetic force. However, there is a disadvantage in color development since the magnetic material is usually opaque. Thus, the non-magnetic mono-component developing method in which toner only with no opaque magnetic material is used is desirable for color development.

FIGS. 1–4 show examples of an electrophotography conventional developing apparatus, in which a non-magnetic mono-component developing method according to the conventional art is employed. The ordinary developing apparatus is composed of a developing roller for developing a latent image formed on a photosensitive drum by moving the toner, a supplying roller for supplying the toner on the developing roller, and a doctor blade for forming a thin toner layer on the developing roller.

Referring to the appended drawings, the developing apparatus according to the conventional art will be briefly described.

FIG. 1 shows an example where an elastic developing roller 11 effects the development while in contact with the photosensitive body (drum). Here, the elasticity of the developing roller 11 is achieved using a silicon rubber, natural rubber, polyurethane, or the like. Developing roller 11 has the electrical properties of a semiconductor. In FIG. 1, reference numeral 2 is a toner supplying roller, reference numeral 3 represents the toner, reference numeral 4 is a doctor blade, and reference numeral 5 is a photosensitive drum.

FIG. 2 shows an example where a hard developing roller 11' effects the development in a non-contacting state, being separated from photosensitive drum 5 by a developing gap a. Here, the developing roller is made of a metal such as aluminum or stainless steel. These materials are electrically conductive so that a biasing means 8 may provide a DC current, an AC current or some combination thereof, for application to photosensitive drum 5. In FIG. 2, reference numeral 4' is an elastic doctor blade. The developing apparatus of FIG. 2 does not employ a toner supplying roller.

FIG. 3 shows an example where a hard developing roller 11' effects the development while in contact with a flexible photosensitive body 51 in the form of a belt. Here, the developing roller is made of metal as the example in FIG. 2. In FIG. 3, reference numeral 4 represents a doctor blade, and reference numeral 2 represents a toner supplying roller.

FIG. 4 shows an example of a photosensitive apparatus using a toner-flying developing method where the developing roller 11' operates at a constant gap from photosensitive drum 5. Here, biasing means 8 causes the toner 3 on developing roller 11' to "jump" onto the drum by a DC voltage applied across developing roller 11' and photosensitive drum 5. In the apparatus of FIG. 4, the developing roller 11' is made of aluminum or stainless steel and a non-magnetic toner is used. Also, doctor blade 4' is elastic.

The problems of the conventional electrophotography developing apparatuses as described above are as follows.

First, the problems related to the case of the contact development will be discussed. The photosensitive body and the developing roller revolve while contacting each other. Generally, the developing roller revolves at a higher speed than the photosensitive drum. Here, the "contact" development actually has a developing gap which is generally equal to about one to two layers of toner, and consequentially there is nipping action between the soft roller and the photosensitive drum. As described above, the developing roller must revolve at a higher speed than the photosensitive drum, since the toner supply to the photosensitive drum would be insufficient were it to revolve at the same speed, and an inadequate supply of charged toner means that the obtained image is insufficiently dense, making for an image of poor quality. That is, a large amount of toner has to be supplied to the photosensitive drum by revolving the developing roller at the higher speed, in order to provide an image in sufficient concentration. However, since the developing roller and the photosensitive drum revolve at different speeds, friction is generated, which causes undue wear and reduces the lifetime of the photosensitive drum. The friction and resulting surface deterioration also adversely affects the toner supply such that the application thereof is uneven due to variations in the surface roughness of the circumference of the developing roller. Moreover, unwanted frictional charging and the developing characteristics of the toner are degraded.

Further in the case of the contact development, it is difficult to maintain a constant revolving speed of the developing roller, such that the linear velocity thereof is easily changed. As a result, inconsistent amounts of toner are supplied, whereby an image having an even density throughout cannot be provided. Furthermore, the above-described friction applies a load of opposing direction to its revolving to the developing roller, and another load of coinciding direction with its revolving to the photosensitive drum. Such loads result in a loss of power.

Additionally in the case of the contact developing, the interval between the photosensitive body and the developing roller is equal to about one to two times the diameter of toner particle. Here, the field strength in the gap between the photosensitive drum and the developing roller, that is, in the space for developing, is much stronger, by as much as several times, for a line image than for a solid image. Thus, after developing, the line image exhibits a higher concentration than does the solid image, which is good for a printer or facsimile dealing with a digital image. However, due to poor tonal gradation, the above characteristic is not suitable for a duplicator requiring a soft image output.

Another unsolved problem in the electrophotography developing method is that the consistent quality of both line and solid images cannot be obtained simultaneously. Thus, a method giving priority to one (line image or solid image) is adopted. Generally, the priority is given to the line (or dot) image in the case of printers and facsimiles, and to the solid image in the case of the duplicator, when setting up the field strength and the developing gap.

Next, the problems with respect to the roller will be considered.

The developing roller is roughly classified into hard and soft rollers. The hard roller is typically made of stainless steel or aluminum and is electrically conductive, and has a proper surface roughness. For hard rollers, synthetic rubber is used for the doctor blade for the toner layer. However, in this case, the amount of specific charge of the toner is small, that is, only 10 μC/g or below. If the specific charge is small, a smooth image cannot be obtained due to the poor tonal gradation. Also, toner easily assume opposite-polarity, many problems are generated, such as the violent flinging (flying) of the toner and contamination of the image's background which lower image quality, as well as reduced machine lifetime and an increased possibility of malfunction. Since there is a concern about contact between the photosensitive body and the developing roller, the developing gap, that is, the gap between the surface of the photosensitive body and that of the developing roller, cannot be shortened beyond a certain limit.

In the case of the conventional hard roller, the developing gap is ordinarily set above 0.2 mm. Here, the above-described field strength is stronger for solid images than line images, thereby producing an indistinct line image. Also, since the developing roller is conductive, the field strength is sensitively varied in accordance with the developing gap, which requires very high machining precision for the developing roller. Thus, it is difficult to obtain images having an even concentration with an ordinary machining precision, due to severe variations in image concentration.

In the case of the soft roller, the major component of the soft roller is polyurethane rubber or silicon rubber and various functional additives are added therein so as to have semi-conductivity with the specific resistance of $10^7$–$10^8\Omega\cdot$cm. In the same way, the surface of the soft roller is machined to have the same surface roughness as the size of the toner particles (5–10 μm), in order to actively form the toner layer. Here, a solid bar, an elastic board, or a doctor blade in the shape of a roller is installed as means for forming the toner layer, and a polyurethane sponge is used as means for charging the toner. Here, the amount of specific charge of the toner can be increased to 20–40 μC/g. Recently, a soft roller having the same specific charge of the toner as that of the bi-component developing method using a magnetic brush was achieved by increasing the specific charge of the toner as much as possible.

If a toner having a high specific charge is used, most of the above problems can be overcome. That is, an image having excellent tonal gradation can be provided, the flying of toner is decreased and the generation of opposite-polarity toner is decreased, whereby a high quality image without contamination in the background can be provided. Also, in the case of the soft roller, the photosensitive body is not damaged even though the soft roller contacts the photosensitive body. As a result, the developing gap can be freely set to the optimum state, without regard to solid-image or line-image priority.

Since the rubber used in the soft roller is a semi-conductive material, the sensitivity to the field strength of the developing gap is not high. Thus, high quality images with even concentration can be obtained with the ordinary machining precision.

In a contact developing method using a hard roller, a photosensitive belt is used instead of the photosensitive drum. Here, however, the photosensitive belt has more disadvantages than the photosensitive drum. That is, it is more difficult to drive the belt than the drum, and the belt has a shorter lifetime and inferior durability, such that a high degree of product reliability is not attainable and poor quality images are frequently produced.

SUMMARY OF THE INVENTION

It is an object of the present invention to provide a non-contacting non-magnetic mono-component developing apparatus using a soft roller which provides a desirable image for both solid and line images.

The non-magnetic mono-component developing apparatus according to the present invention comprises: a developing rubber roller made of an elastic rubber having a semi-conductivity and having the same surface roughness as that of a toner particle; a toner supplying roller made of a foam-type material for supplying the toner and charging the toner by a friction according to nipping with the developing rubber roller; doctor means for forming a thin toner layer on the surface of the developing rubber roller while contacting the developing rubber roller; a photosensitive drum maintaining a developing gap between the drum and the developing rubber roller so that developing of an image is performed without contact with the developing rubber roller; and an electric power source for applying a predetermined bias voltage across the developing rubber roller, the toner supplying roller and the photosensitive drum.

As a result of the above constitution according to the present invention, a problem related to the friction between the photosensitive drum and the developing roller can be solved. Also, a problem of unevenness in the image concentration sensitively affected by the field strength can be overcome by using the soft roller. Also, excellent image quality for both solid and line images can be produced by properly setting the developing gap. In other words, the developing apparatus for use in electrophotography according to the present invention eliminates the disadvantages existing when the contact developing method using a hard roller is employed.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Referring to the appended drawings, the present invention will be described hereinafter.

Figure 5:
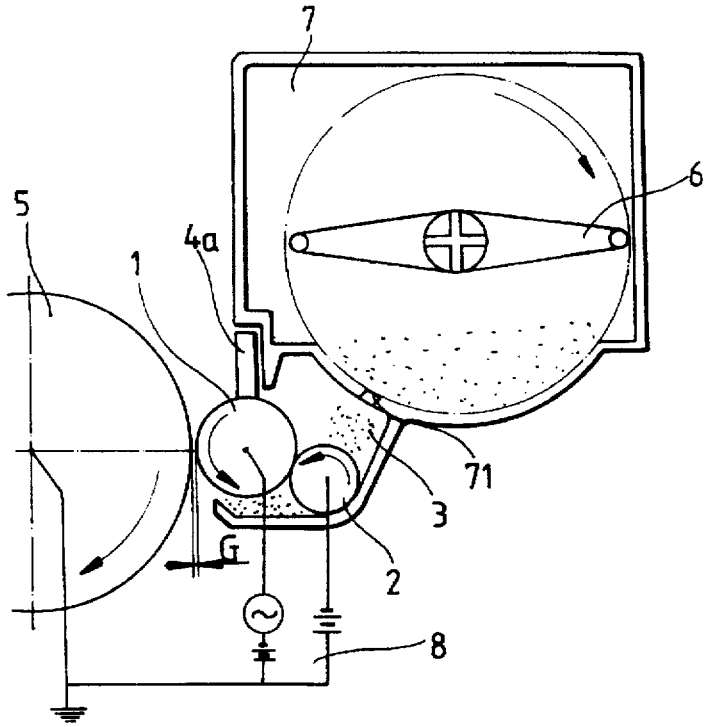
FIG. 5 is a schematic cross-sectional view of the developing apparatus according to the present invention.

FIG. 5 is a schematic cross-sectional view showing the important portions of the developing apparatus according to the present invention. The electrophotography developing apparatus according to the present invention comprises a developing rubber roller 1 revolving counterclockwise, a toner supplying roller 2 revolving clockwise while contacting one side of developing rubber roller 1, a doctor blade 4*a* for controlling the amount of toner in contact with the upper portion of developing rubber roller 1, a photosensitive drum 5 revolving clockwise while having a constant gap G from the other side of developing rubber roller 1, a housing 7 containing a revolving toner mixer 6, for supplying the toner to a toner supplying chamber located behind a bulkhead via a toner supplying hole 71, and an electric power source 8 for applying the voltage across photosensitive drum 5, developing rubber roller 1 and toner supplying roller 2.

Toner 3 filled in housing 7 of the developing apparatus is supplied to the toner supplying chamber having toner supplying roller 2 therein via toner supplying hole 71 formed on the bulkhead, in accordance with revolving of toner mixer 6. Toner supplying roller 2 is made of a material such as a foam urethane, revolves with the toner attached thereon, and makes friction with the surface of developing rubber roller 1. Developing rubber roller 1 adopts a rubber roller made of urethane or silicon. Here, toner 3 is charged by the friction and is attached on the developing rubber roller by the image force. The amount of the attached toner is controlled by the direct contact between developing rubber roller 1 and doctor blade 4*a* so that one or two toner layers are formed on developing rubber roller 1. Thereafter, attached toner 3 is moved into a developing region to develop an image, where developing rubber roller 1 faces photosensitive drum 5.

In the developing region, the toner is selectively attached in accordance to an electrostatic latent image formed on photosensitive drum 5 and the strength of coulomb force caused by the developing bias voltage applied across developing rubber roller 1 and photosensitive drum 5. Here, since the gap as much as a predetermined developing gap G is provided between photosensitive drum 5 and developing rubber roller 1, the developing process is performed in a state where photosensitive drum 5 and developing rubber roller 1 do not contact each other. Developing gap G is set to be a little broader than the height of the toner layer to be formed on the surface of developing rubber roller 1. The number of toner layers formed on developing rubber roller 1 is generally one or two. It is desirable that the position of photosensitive drum 5, without contacting with the toner layers, is separated from developing rubber roller 1, by as much as four to five times the diameter of toner particle. Thus, if the conventional toner particle with diameter of 10 μm is used, the developing gap is set apart from the developing rubber roller, by as much as 40–50 μm.

The developing gap has to be properly set to produce an image having an optimum developing characteristic in which field strengths of solid and line images are nearly the same to provide the same level of concentration in all of solid and line images. The optimum developing gap can be changed in accordance with density of line image, line thickness, and the surface electric potential of photosensitive body. That is, the higher density and the less line thickness are, the narrower developing gap is. The width of this developing gap is much narrower than non-contacting developing gap using the hard roller and is about 50–200 μm. Also, the maximum allowable developing gap is set such that the field strength of line image is not zero, that is, the field strength can be maintained as much as several tens percentages of that of solid image.

Figure 6:
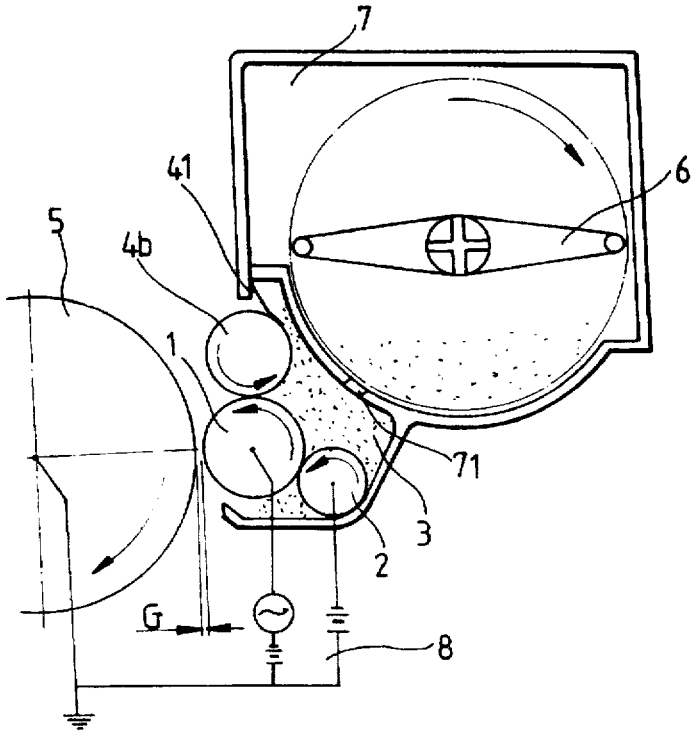
FIG. 6 is a cross-sectional view showing a preferred embodiment according to the present invention.
Figure 7:
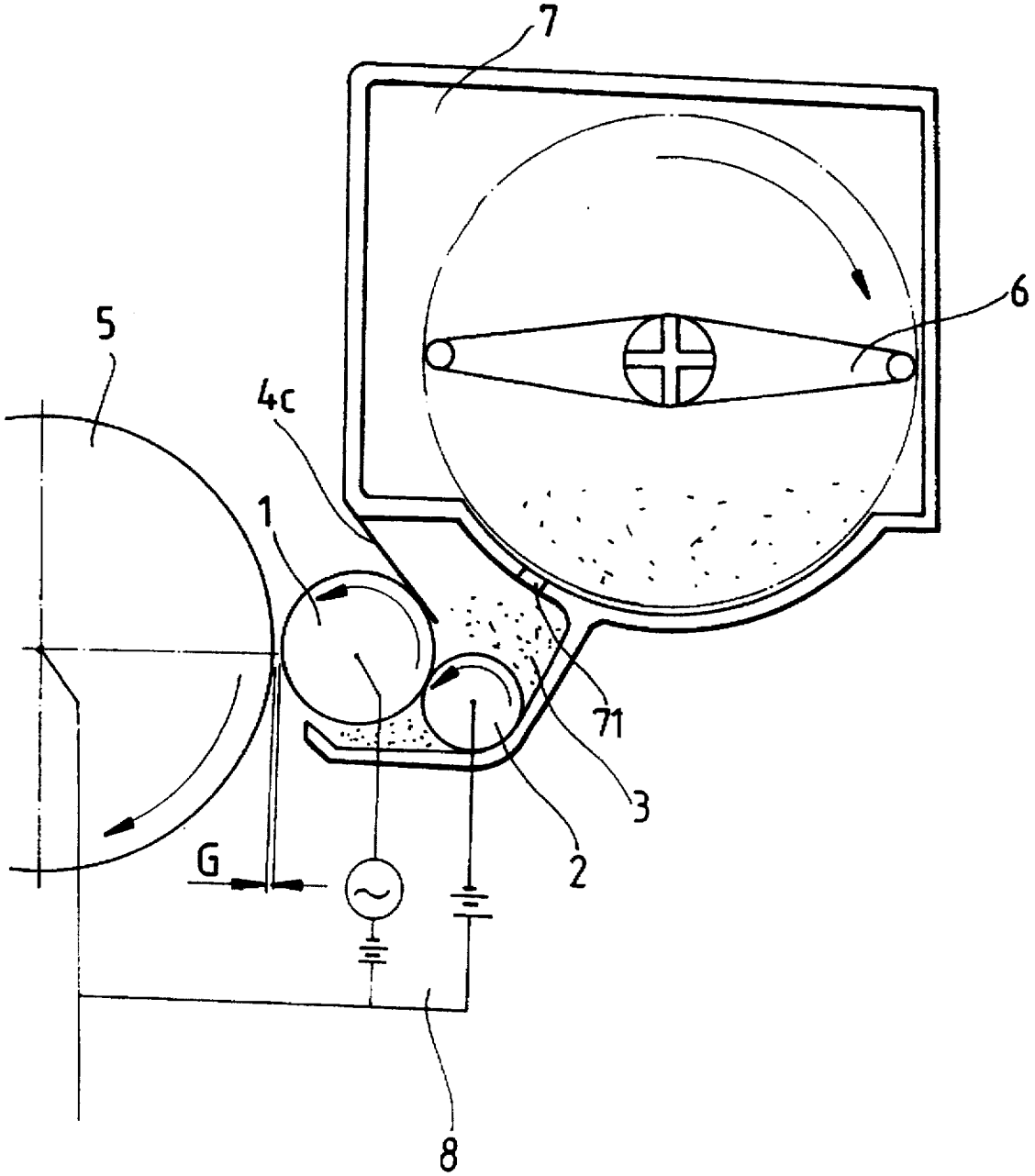
FIG. 7 is a cross-sectional view showing another preferred embodiment according to the present invention.

As shown in FIGS. 5–7, the voltage applied to developing rubber roller 1 can be an alternating current voltage to raise the developing efficiency, which easily separates the toner by disturbing the toner layer attached on developing rubber roller 1 using an electrical force at the developing region. Also, the direct current voltage is applied to toner supplying roller 2 to raise the toner supplying efficiency together with the amount of specific charge of toner. Furthermore, if the developing bias voltage is applied as a spherical wave and the duty thereof is adjusted, the image in a desirable concentration without the contamination of background can be obtained.

The difference between the apparatuses according to the present invention and the above-described conventional art will be summarized in the table below, in view of the type of developing roller and the contact state between the roller and photosensitive body.

As shown in the table, the present invention can solve the problems generated in the cases where the photosensitive body and the developing roller contact each other, and the hard developing roller is used.

FIG. 6 shows a preferred embodiment of the present invention. In this embodiment, a doctor roller 4*b* is used instead of the doctor blade to evenly form the toner layer on developing roller 1, and a scraper 41 used for doctor roller 4*b* is further provided.

Figure 1:
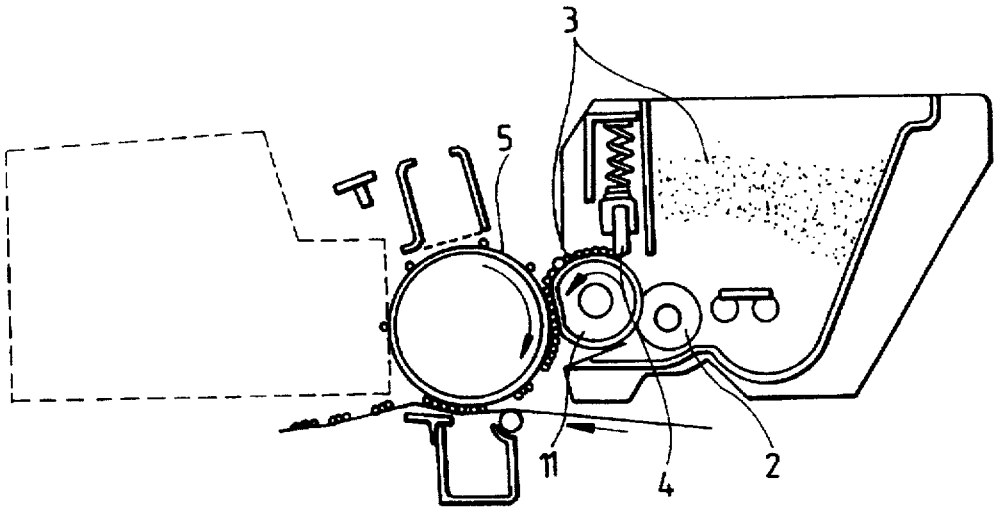
FIG. 1 (PRIOR ART)
FIG. 1 is a schematic side view of a conventional developing apparatus.
Figure 2:
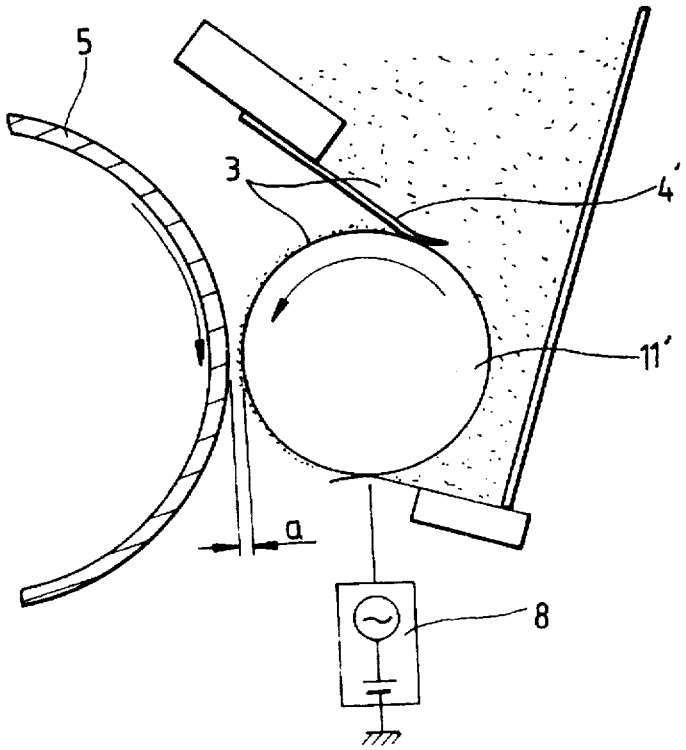
FIG. 2 (PRIOR ART)
FIG. 2 is a schematic side view of the important portions of another developing apparatus according to the prior art.
Figure 3:
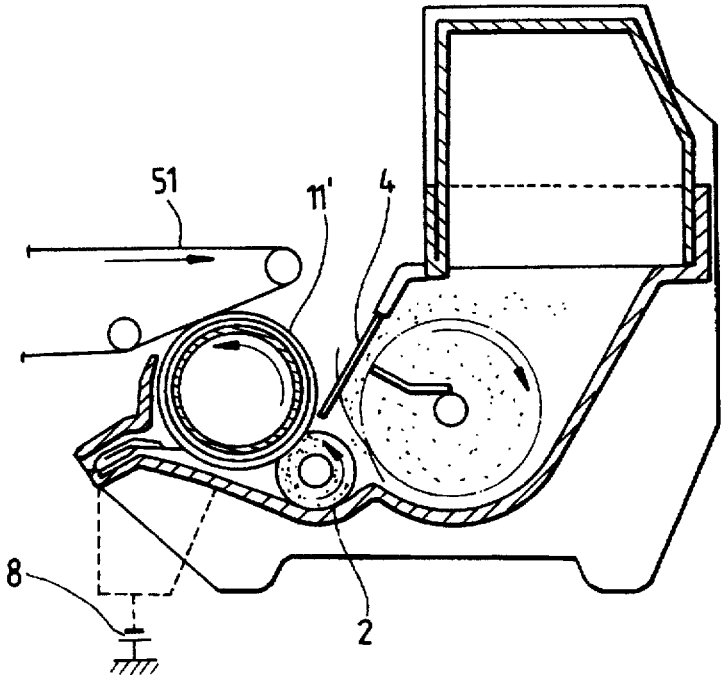
FIG.3(PRIOR ART)
FIG. 3 is a schematic side view of still another conventional developing apparatus.
Figure 4:
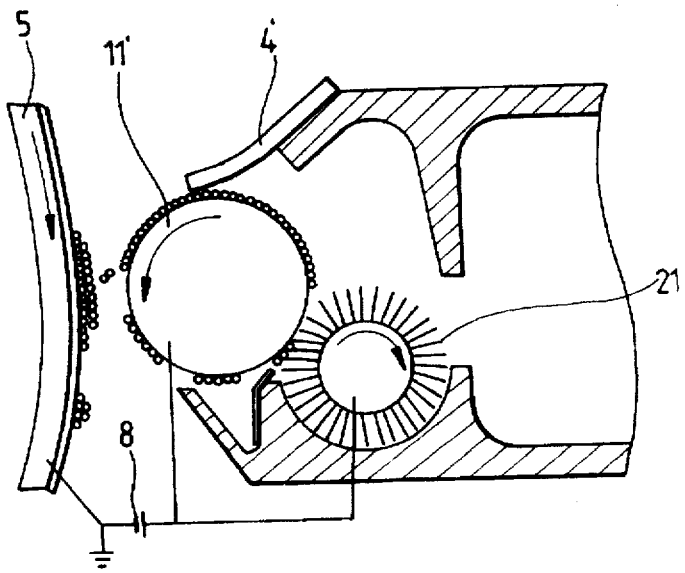
FIG.4(PRIOR ART)
FIG. 4 is a schematic side view of yet another developing apparatus.

| roller type | contacting | non-contacting |
|---|---|---|
| hard | FIG. 3 (U.S. Pat. No. 4,696,255) | FIG. 2 (U.S. Pat. No. 4,866,480) & FIG. 4 (U.S. Pat. No. 4,766,460) |
| soft | FIG. 1 (U.S. Pat. No. 5,051,332) | FIGS. 5, 6 & 7 (present invention) |

FIG. 7 shows another preferred embodiment of the present invention. In this embodiment, an elastic plate 4*c* instead of the doctor blade is used.

The electrophotography developing apparatus according to the present invention is a non-contacting non-magnetic mono-component developing apparatus using the soft roller, which provides an image of good quality exhibiting even concentration for both solid and line images.

What is claimed is:

1. A non-contacting, non-magnetic, mono-component developing apparatus comprising:

a developing roller made entirely of a polyurethane rubber having a semi-conductivity and a same surface roughness as that of a toner particle;

a toner supplying roller made of a polyurethane foam for supplying the toner particles and for charging the toner particles on said supplying roller by a frictional nipping action with said developing roller;

doctor means for forming a uniformly thin toner layer on the surface of said developing roller while contacting said developing roller;

a photosensitive drum which is maintained at a developing gap between said drum and said developing roller so that developing of an image on said drum is performed without contact with said developing roller;

an electric power source for applying a predetermined bias voltage across said developing roller, said toner supplying roller and said photosensitive drum, wherein said bias voltage is a combination of a direct current and an alternating current, with said developing roller and said drum having said alternating current applied thereto and said toner supplying roller having a direct current applied thereto, whereby image density is increased as said gap is decreased, wherein said gap is no more than five times a mean diameter of said particles.

2. The developing apparatus of claim 1, wherein said image is comprised of solid areas and line areas and wherein said image density of each of said areas is maximized and uniform when said developing gap is between 50–100 μm.

* * * * *